US007329631B1

(12) United States Patent
Burnett

(10) Patent No.: US 7,329,631 B1
(45) Date of Patent: Feb. 12, 2008

(54) METHOD OF APPLYING AN IMAGE TO AN OBJECT

(75) Inventor: John A. Burnett, Martinez, CA (US)

(73) Assignee: CafePress.com, San Leandro, CA (US)

( * ) Notice: Subject to any disclaimer, the term of this patent is extended or adjusted under 35 U.S.C. 154(b) by 361 days.

(21) Appl. No.: 10/986,754

(22) Filed: Nov. 9, 2004

(51) Int. Cl.
*B41M 5/035* (2006.01)
*B41M 5/50* (2006.01)

(52) U.S. Cl. ..... 503/227; 8/471

(58) Field of Classification Search ..... 503/227; 8/471

See application file for complete search history.

(56) References Cited

U.S. PATENT DOCUMENTS

| | | | | |
|---|---|---|---|---|
| 3,663,350 | A | 5/1972 | Stokes | 161/151 |
| 4,870,796 | A | 10/1989 | Hart et al. | 52/409 |
| 5,248,363 | A | 9/1993 | Hale | 156/230 |
| 5,251,416 | A | 10/1993 | White | 52/410 |
| 5,296,081 | A | 3/1994 | Morin et al. | 156/498 |
| 5,372,987 | A * | 12/1994 | Fisch et al. | 503/227 |
| 5,674,336 | A | 10/1997 | Coe | 156/71 |
| 5,948,728 | A | 9/1999 | Patton et al. | 503/227 |
| 6,320,172 | B1 | 11/2001 | Watkins | 219/725 |
| 6,409,330 | B1 * | 6/2002 | Nakamura et al. | 347/103 |
| 6,544,909 | B1 | 4/2003 | Venkataswamy et al. | 442/38 |
| 6,586,080 | B1 | 7/2003 | Heifetz | 428/198 |
| 6,765,182 | B2 | 7/2004 | Cole et al. | 219/759 |
| 2002/0039928 | A1 | 4/2002 | Spurgeon et al. | 473/125 |
| 2002/0148054 | A1 * | 10/2002 | Drake | 8/509 |
| 2002/0160673 | A1 | 10/2002 | Zupon et al. | 442/31 |
| 2002/0187693 | A1 | 12/2002 | Cherry | 442/32 |
| 2003/0005658 | A1 | 1/2003 | Folkersen | 52/408 |
| 2003/0079638 | A1 | 5/2003 | Burnett | 101/492 |
| 2003/0100233 | A1 | 5/2003 | Fynan et al. | 442/58 |
| 2003/0118852 | A1 | 6/2003 | Venkataswamy et al. | 428/516 |
| 2003/0192136 | A1 * | 10/2003 | Magee et al. | 8/500 |

FOREIGN PATENT DOCUMENTS

EP 1193284 A1 4/2004

OTHER PUBLICATIONS

Merriam-Webster's Dictionary (online ed. 2006-2007), available at http://www.merriam.com.*

* cited by examiner

*Primary Examiner*—Milton I. Cano
*Assistant Examiner*—David J. Joy
(74) *Attorney, Agent, or Firm*—David H. Jaffer; Pillsbury Winthrop Shaw Pittman LLP

(57) ABSTRACT

A method for applying sublimation ink to an object. An ink transfer medium is placed in contact with an object surface that is coated with a material receptive to the ink. Microwave susceptor material is placed over the transfer medium, and clamped onto the object surface. The clamped assembly is energized in a microwave oven. Energy absorbed by the susceptor material is converted into heat energy, which heats the sublimation ink, causing it to sublimate and penetrate into the receptive coating.

4 Claims, 2 Drawing Sheets

METHOD OF APPLYING AN IMAGE TO AN OBJECT

BACKGROUND OF THE INVENTION

1. Field of the Invention

The present invention relates generally to methods of placing an image on an object, and more particularly to a method of transferring an image onto an object using a sublimation dye transfer medium where the medium is heated using microwave energy absorbed in an element for converting the microwave energy into heat.

2. Description of the Prior Art

The application of images to objects by way of sublimation transfer dyes is well documented in the prior art. U.S. patent application Pub. No. U.S. 2003/0079638A1 by Burnett describes printing images onto metal containers. An image is printed on a sublimation heat transfer sheet using a sublimation ink/dye. The heat transfer sheet is then pressed against a container surface that is receptive to the sublimation dye/ink and heat and pressure are applied.

U.S. patent application U.S. 2002/0039928A1 by Spurgeon et al. describes methods of transferring an image to a bowling ball using a printed sublimation medium.

U.S. Pat. No. 5,948,728 by Patton et al. describes a method of placing images on a mug, and provides details on printing the image on a transfer sheet.

In these prior art methods, the application of heat and pressure is briefly mentioned without much detail. Patton says heat can be applied by placing the mug in a conventional oven, or a microwave oven if the clamp is made of an appropriate material (col. 7, lines 6-8). No method is described as to how microwave energy is converted into heat energy for heating the sublimation dye. U.S. Pat. No. 5,296,081 by Morin et al. provides a description of how heat is applied to outside and inside surfaces of a tubular container using flexible silicon heaters configured as a one piece unit.

SUMMARY OF THE INVENTION

Briefly, a preferred embodiment of the present invention includes a method for applying an image to an object using a sublimation transfer medium including an image printed on a sublimation transfer sheet with sublimation dye/ink. The sublimation transfer medium is then placed in contact with an object surface that is coated with a material receptive to the sublimation dye/ink. A sheet of microwave susceptor material is then placed over the sublimation transfer medium, and the two piece laminate is clamped onto the object surface. The clamp in the preferred embodiment is constructed of material that is non-conductive in order to avoid interfering with microwave radiation reaching the susceptor. The clamped assembly is then placed in a microwave oven, which is energized. The microwave energy is absorbed by the susceptor material and converted into heat energy, which heats the sublimation ink/dye, causing it to sublimate and penetrate into the receptive coating.

IN THE DRAWING

DETAILED DESCRIPTION OF THE PREFERRED EMBODIMENTS

Figure 1:
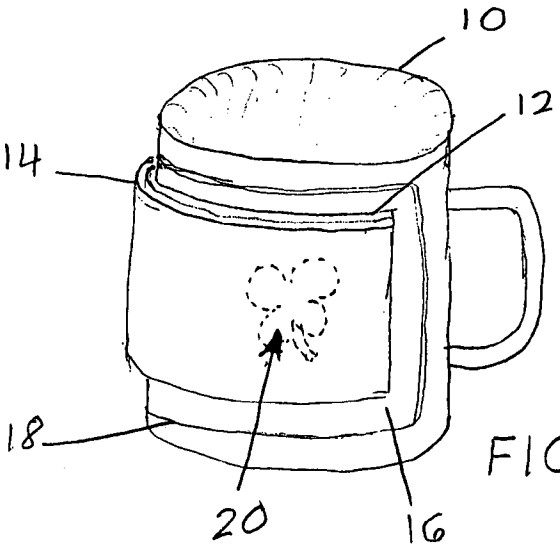
FIG. 1 shows a mug with a sublimation transfer medium and a microwave susceptor.

A preferred embodiment of the present invention will now be described in reference to FIGS. 1-4 of the drawing. FIG. 1 shows a mug 10 with two layers of material 12 and 14 positioned on an outside surface 16. A mug is chosen for illustration, but the present invention includes any object on which the two layers can be positioned, that has a surface compatible with receiving sublimation ink, and that can tolerate heat that is applied to the ink. The surface 16 as shown in FIG. 1 is of a material 18 that is receptive to sublimation dye/ink, such as a polymer, or more specifically a polyester coating. Other materials receptive to sublimation ink are also included in the method as described herein and will be understood by those skilled in the art. The layer 12 is a transfer release sheet with an image 20 printed thereon with a sublimation dye/ink. Layer 14 is a material that can absorb microwave energy and convert it to heat, for heating the ink. An example material is a microwave susceptor layer positioned over the transfer sheet 12 according to the present invention. The susceptor absorbs the applied microwave energy and converts it to heat energy, heating the ink and causing it to sublimate and migrate into the layer 18 on the mug 10. With the layers 12 and 14 clamped onto the mug 10, it is then subjected to microwave energy. This process will be illustrated in reference to FIGS. 3 and 4.

Figure 2:
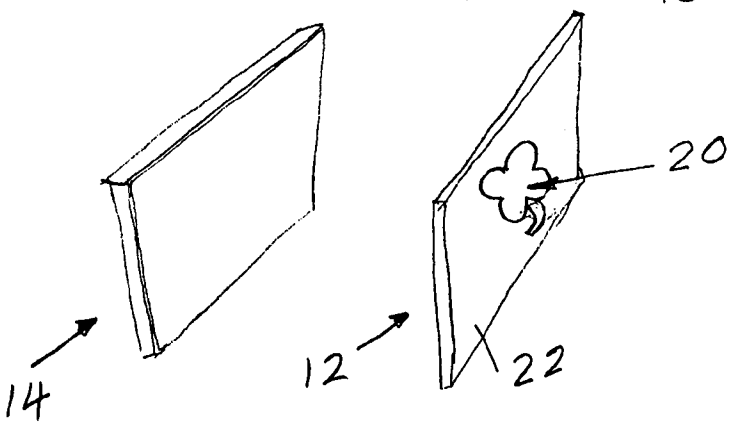
FIG. 2 illustrates the susceptor and transfer medium with a design.

FIG. 2 illustrates the microwave absorbing layer 14 and transfer medium 12 more clearly. The transfer medium includes a sheet of material 22, on which is printed an image 20 with sublimation ink/dye. The material 14 absorbs microwave energy and causes it to be converted into heat energy. The microwave absorbing material can be any of various materials that can be configured for absorbing microwave frequency radiation for converting it to heat, and, that can be effectively positioned to allow the heat to reach the sublimation ink. For example, it can be a microwave susceptor such as is used in the food industry, and may be configured as a sheet dielectric (non-conductive) material coated with a layer of metal, wherein the metal thickness is designed to provide an adequate resistance/absorption of the microwave energy. Other constructions that will be apparent to those skilled in the art are also included in the present invention.

Figure 3:
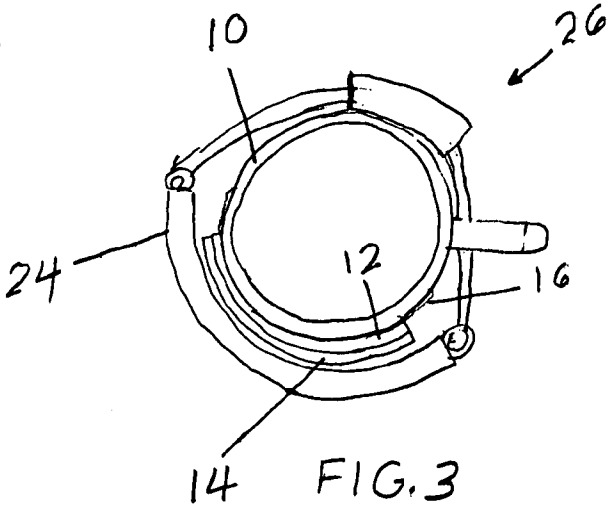
FIG. 3 shows clamping the transfer medium and susceptor to the mug.

FIG. 3 shows an assembly 26, including a symbolically illustrated clamping device 24 for holding the layers 12 and 14 in contact with the coating material 16 while microwave energy is applied. The clamp 24 is designed so as to allow passage of the applied microwave frequency radiation, and is preferably constructed of a non-electrically conductive and low loss material, so as not to reflect or absorb the applied microwave frequency radiation prior to reaching the material 14. Alternatively, a portion of the clamp in contact with the sublimation sheet 12 can be constructed of a microwave absorbing material for heating the ink, as an alternative to a separate layer 14, or in addition to it. For illustrative purposes, the layer 14 can in this alternative be considered attached to the clamp 24. The object, or mug of FIG. 1, is also preferably constructed of a non-electrically conductive material so as not to interfere with the microwave frequency being absorbed in the material 14.

Figure 4:
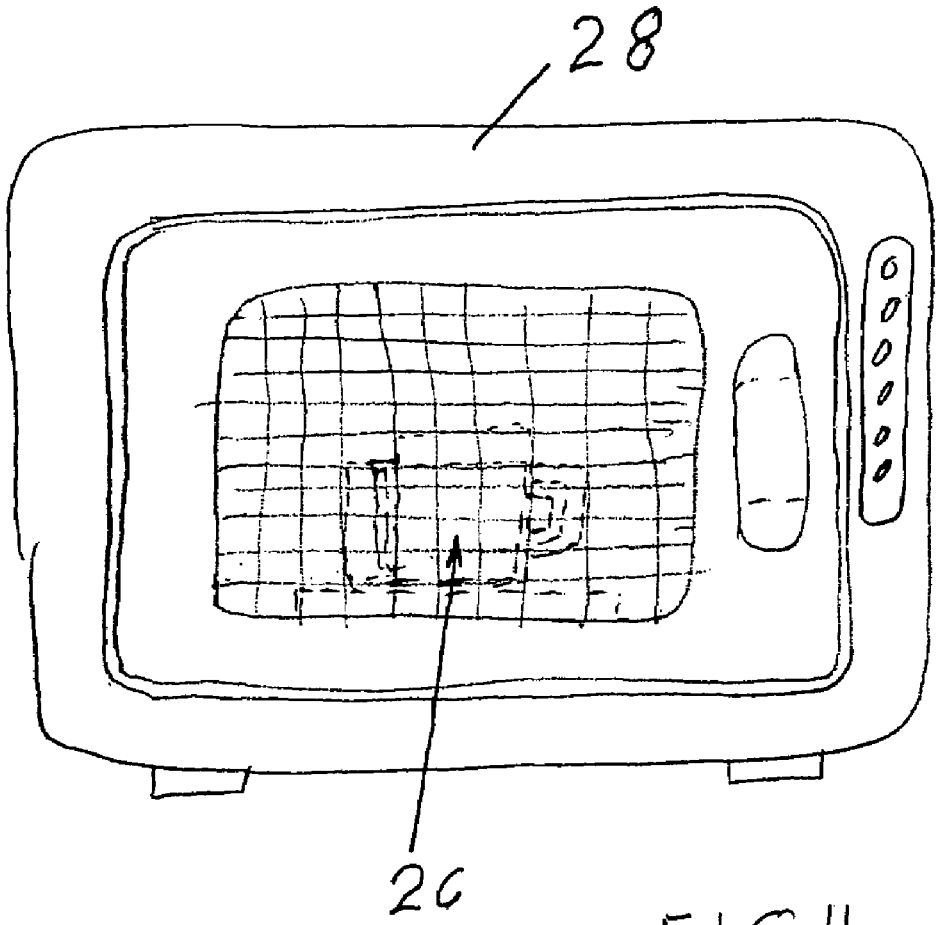
FIG. 4 illustrates the application of heat using a microwave oven.

FIG. 4 shows the assembly 26 of FIG. 3 in a microwave oven 28 for applying microwave energy to the absorbing material/susceptor 14 so as to heat the sublimation ink of the design 20.

The method of the present invention includes placing the material 14 in contact with the sublimation transfer medium 12, and the application of microwave energy to heat the material 14. Details of the process of using a sublimation transfer medium for placing an image on a mug are described in the prior art.

The use of coating materials that are receptive to sublimation ink is described in U.S. patent application Publication U.S. 2002/0039928A1 by Spurgeon et al. The printing of an image on a transfer paper is described in U.S. patent application Publication U.S. 2003/0079638A1 by Burnett. Methods of heating a mug are described in U.S. Pat. No. 5,296,081 by Morin et al.

Microwave susceptor materials are described as used in the microwave food industry, for example in U.S. Pat. No. 6,320,172 by Watkins and 6,765,182 by Cole et al.

The above embodiments of the present invention are given by way of example for illustrating the use of a microwave absorbing material, such as a microwave susceptor, in combination with microwave energy applied for heating a sublimation transfer medium for transfer of an image to any compatible object. Although a mug is illustrated, the method of the present invention also applies to transfer of sublimation ink/dye to other objects. The object must have a surface that will receive sublimation ink/dye, and must be able to withstand the heat applied. The use of various clamping devices, susceptor/microwave absorbable material and transfer mediums will be apparent to those skilled in the art, and the method of the present invention includes the use of these various alternative structures and materials.

What is claimed is:

1. A method of applying an image to an object comprising:

(a) positioning a sublimation transfer medium having a sublimation ink image on the object;

(b) positioning a microwave susceptor comprising of a sheet of dielectric material coated with a metal of thickness that absorbs microwave frequency radiation over the sublimation transfer medium;

(c) clamping the transfer medium and the microwave susceptor to the obiect with a clamp, wherein the object and the clamp are not electrically conductive; and (d) subjecting the microwave susceptor to microwave frequency radiation.

2. A method as recited in claim 1 wherein the object includes a coating with a material receptive to sublimation ink.

3. A method as recited in claim 2 where the coating includes a polymer.

4. A method as recited in claim 3 where the coating is polyester-based.

* * * * *